US008225620B2

(12) United States Patent
Prentner

(10) Patent No.: US 8,225,620 B2
(45) Date of Patent: Jul. 24, 2012

(54) REFRIGERATOR UNIT AND/OR FREEZER UNIT

(75) Inventor: Andreas Prentner, Lienz (AT)

(73) Assignee: Liebherr-Hausgerate Lienz GmbH, Lienz (AT)

( * ) Notice: Subject to any disclaimer, the term of this patent is extended or adjusted under 35 U.S.C. 154(b) by 594 days.

(21) Appl. No.: 12/380,099

(22) Filed: Feb. 24, 2009

(65) Prior Publication Data

US 2009/0229287 A1 Sep. 17, 2009

(30) Foreign Application Priority Data

Feb. 26, 2008 (DE) ..... 20 2008 002 700 U
Apr. 2, 2008 (DE) ..... 20 2008 004 544 U

(51) Int. Cl.
*F25B 49/00* (2006.01)
*F25D 23/06* (2006.01)
*F25D 17/06* (2006.01)

(52) U.S. Cl. ..... 62/176.1; 62/274; 62/426

(58) Field of Classification Search ..... 62/176.1, 62/127, 274, 426, 440
See application file for complete search history.

(56) References Cited

U.S. PATENT DOCUMENTS 5,400,612 A * 3/1995 Hedges ..... 62/171
2005/0217282 A1 * 10/2005 Strohm et al. ..... 62/78

FOREIGN PATENT DOCUMENTS

EP 1586824 A2 * 10/2005
KR 2003081927 A * 10/2003

* cited by examiner

*Primary Examiner* — Chen Wen Jiang
(74) *Attorney, Agent, or Firm* — Dilworth & Barrese, LLP.

(57) ABSTRACT

The present invention relates to a refrigerator unit and/or a freezer unit having at least one compartment located in the interior space of the refrigerator unit and/or freezer unit, wherein means are provided for air moistening by means of which the relative humidity in the compartment can be set.

17 Claims, No Drawings

REFRIGERATOR UNIT AND/OR FREEZER UNIT

BACKGROUND OF THE INVENTION

The present invention relates to a refrigerator unit and/or a freezer unit having at least one compartment located in the interior space of the refrigerator unit and/or freezer unit.

The storage life of refrigerated goods can be considerably extended by the storage of such refrigerated goods, in particular perishable refrigerated goods, within closely defined temperature limits, preferably just above freezing point, as well as in closely defined humidity ranges. Reports have also been made in this connection of improved stability of vitamins and other health-promoting components of the refrigerated goods.

Refrigerator units and/or freezer units are known for this purpose from the prior art comprising separate compartments in which so-called zero degree zones are set. These compartments are provided for the reception of perishable refrigerated goods and result in an increase in the storage life of these refrigerated goods.

To date, however, there has been no possibility to set the humidity effectively in these compartments in addition to the temperature. However an improvement of the storage conditions and under certain circumstances a further extension to the storage life of the refrigerated goods could hereby be achieved.

SUMMARY OF THE INVENTION

It is therefore the object of the present invention to provide a refrigerator unit and/or a freezer unit which overcomes the drawbacks known from the prior art in an advantageous manner.

This object is solved by a refrigerator unit and/or a freezer unit having the features herein. Provision is accordingly made that a refrigerator unit and/or a freezer unit is provided with at least one compartment in the interior space of the refrigerator unit and/or freezer unit, with means being provided for air moistening by means of which the relative humidity in the compartment can be set. The humidity can preferably be set within narrow limits via the means for air moistening so that the storage life of e.g. peripheral refrigerated goods can be improved. The storage life of e.g. fruit and vegetables can thus be extended.

The compartment is preferably configured such that the temperature in the compartment can be set or is set within a narrow temperature range, differing from the temperature of the remaining interior space. It is conceivable in this connection to establish so-called zero degree zones in the compartments so that the temperature in the compartments is maintained just above freezing point, e.g. in a range from 0°-3°. A best possible temperate/humidity combination can thus be set which is, for example, at 0°-3° and at a humidity of at least 75%. It is equally conceivable in this respect that the compartments are such which have a higher temperature than the remaining interior space of the refrigerator unit and/or freezer unit. Such applications are found e.g. in a use in research or in the commercial use of refrigerator units and/or freezer units.

The means for air moistening can have a fan, with moistened air being conveyed into the compartment by means of the fan. Such a solution has the advantage of a simple realization capability. Furthermore, such a solution is very insensitive to disturbance influences and thus has good security against failure and good stability.

Provision can furthermore be made that the means for air moistening have an air conducting system by means of which the moistened air is conveyed into the compartment. Such an air conducting system allows an exact charging of the compartments with moistened air so that, differing from the remaining interior space, a humidity can be set within the compartments which moves within narrow range limits.

The means for the air moistening can furthermore have a tank system and/or make use of a tank system in which water is stored. The water can, for example, be cooled water. The water does not necessarily have to be cooled water, however. The temperature of the compartments is only influenced insignificantly if at all due to the access to water, for example to cooled water. It thereby becomes possible to maintain the temperature of the compartments within narrow limits without having to make a complex and/or expensive effort for this purpose. It furthermore becomes possible due to the tank system to provide the water stocks required for the moistening for a longer time period. This facilitates the handling for the user who thus only has to fill the tank system at regular intervals.

It is furthermore possible that the tank system is a component of an ice maker. With such an embodiment, a tank system is already present in which cooled water is stored for the automatic preparation of ice cubes by the refrigerator unit and/or freezer unit. The energy efficiency can be substantially increased by the common use of such a tank system.

It is of advantage if the tank system includes a decalcification device and/or a cleaning device. Such decalcification devices can be filters at the inlet of the tank system e.g. active carbon filters. The cleaning device can also be an antibacterial coating or a UV light source of the tank system. The service life of the refrigerator unit and/or freezer unit is increased and the service intervals decreased by the de-calcification. The advantage results from the cleaning device that the air blown into the compartments is low in germs, which in turn has a positive effect on the refrigerated goods stored in the compartments.

Provision can furthermore be made that the tank system has a separate water connection. The advantage also results in such an embodiment that the user no longer has to look after the filling of the tank system. The tank system is topped up as required via the water connection.

Provision can be made in an advantageous embodiment that the means for air moistening are arranged at least partly in the foamed intermediate wall space of the container of the refrigerator unit and/or freezer unit. The interior space of the refrigerator unit and/or freezer unit is not reduced in volume thereby. The advantage furthermore results that the means for air moistening are arranged securely and not visibly.

It is furthermore possible that the means for air moistening have a blow-out opening located in the upper region of the compartment. Such an arrangement has the advantage that the moistened air is distributed evenly in the compartment. If a plurality of compartments are provided, at least one blow-out opening is located in the top-most compartment. This can already be sufficient to achieve a sufficiently precise setting of the humidity in all compartments.

The means for air moistening can furthermore have a control and/or regulation unit. The humidity in the compartments can thereby be maintained very precisely in a range drawn very closely by threshold values.

Provision can be made in a further embodiment that the means for air moistening have at least one humidity sensor. The humidity in the compartment can be monitored by means of the humidity sensor and e.g. be readjusted on a deviation from the desired value.

The at least one humidity sensor can moreover be arranged in the compartment and/or in spatial association with the compartment.

It is furthermore possible that the means for air moistening are made such that a relative humidity of 85-90% is adopted in the compartment.

DESCRIPTION OF THE PREFERRED EMBODIMENT

Further details and advantages of the invention should be explained in more detail with reference to the embodiment described in the following.

In this respect, the refrigerator unit and/or freezer unit in accordance with the invention has two compartments in the lower region of the refrigerating part in which, differing from the temperature of the remaining interior space of the refrigerating part, a temperature just above 0° C. is set. This 0° C. zone in the compartments is monitored by a control and/or regulation unit which sets the temperature in a narrow temperature range between 0° C. and 3° C. in the two compartments. This allows a longer storage life of refrigerated goods such as fruit, vegetables, sausage and milk products; in addition a surface freezing of the refrigerated goods is prevented.

The means for air moistening are in this respect partly accommodated in the foamed intermediate wall space in order not to have to accept any losses of the interior space volume. Important parts of the means for air moistening such as the tank system, the fan and the air conducting system are thus accommodated outside the inner container.

Blow-out openings through which the moistened air reaches the compartments are provided in each case to the right and to the left at the rear wall side below the dividing plate which separates the two compartments from the remaining interior space of the refrigerating part and in the upper region of the upper compartment.

A tank system connected to the means for air moistening is provided at the rear side of the refrigerator unit and/or freezer unit. In this respect, a fan is mounted in a holding part of the refrigerating part and conveys air moistened by means of the cooled water in the tank system to the compartments.

It is possible with refrigerator units and/or freezer units which are e.g. equipped with an automatic icemaker to make use of the tank system of the icemaker. In these units, the tank system is usually provided with a separate water connection. It is equally possible to fill such a tank system at regular intervals via a refill opening.

The tank system preferably has filter systems by means of which calcification, but also bacterial contamination can be prevented. An active carbon filter can inter alia be provided at the inlet of the tank system. The tank system itself is likewise cooled.

The then current humidity in the compartments is detected by means of a humidity sensor attached in the region of the compartments. It can be set to a range of e.g. 85-90%; however, other humidity ranges with narrow limits can also be set.

By means of the fan, air is moistened continuously by means of the cooled water in the tank system and is conducted to the compartments via the air conducting system. The moistened air flows through the compartments, emerging from the blow-out openings and sets the humidity in the desired range.

The compartments are made in this respect of transparent plastic and are each spaced some centimeters apart from the lower side of the next compartment or of the dividing plate in the upper region so that the compartments have a sufficient flow and supply of air over them. The dividing plate is preferably a horizontal dividing plate. It can be made with means by which the air passage through a channel located, for example, in the rear region of the dividing plate can be changed. The means can, for example, be made in the form of a slider to be activated from the front.

If an exceeding of the threshold values of the humidity within the compartments is determined by the humidity sensor, the power of the fan is varied accordingly. This can take place by a deceleration or acceleration of the fan, but also by a switching in of a further fan.

The invention claimed is:

1. A refrigerator unit and/or a freezer unit having at least one compartment located in the interior space of the refrigerator unit and/or freezer unit, wherein means are provided for air moistening by which the relative humidity can be set in the compartment, the means for air moistening have a tank system and/or make use of a tank system in which water is stored, and the tank system is a component of an icemaker.

2. A refrigerator unit and/or a freezer unit in accordance with claim 1, wherein the compartment is made such that the temperature in the compartment can be set or is set, differing from the temperature of the remaining interior space, in a narrow temperature range.

3. A refrigerator unit and/or a freezer unit in accordance with claim 2, wherein the means for air moistening have a fan, with moistened air being conveyed into the compartment by the fan.

4. A refrigerator unit and/or a freezer unit in accordance with claim 3, wherein the means for air moistening have an air conducting system by which the moistened air is conveyed into the compartment.

5. A refrigerator unit and/or a freezer unit in accordance with claim 2, wherein the means for air moistening have an air conducting system by which the moistened air is conveyed into the compartment.

6. A refrigerator unit and/or a freezer unit in accordance with claim 1, wherein the means for air moistening have a fan, with moistened air being conveyed into the compartment by the fan.

7. A refrigerator unit and/or a freezer unit in accordance with claim 6, wherein the means for air moistening have an air conducting system by which the moistened air is conveyed into the compartment.

8. A refrigerator unit and/or a freezer unit in accordance with claim 1, wherein the means for air moistening have an air conducting system by which the moistened air is conveyed into the compartment.

9. A refrigerator unit and/or a freezer unit in accordance with claim 1, wherein the water is cooled water.

10. A refrigerator unit and/or a freezer unit in accordance with claim 1, wherein the tank system includes a decalcification device and/or a cleaning device.

11. A refrigerator unit and/or a freezer unit in accordance with claim 1, wherein the tank system has a separate water connection.

12. A refrigerator unit and/or a freezer unit in accordance with claim 1, wherein the means for air moistening are arranged at least partly in the foamed intermediate wall space of the container of the refrigerator unit and/or freezer unit.

13. A refrigerator unit and/or a freezer unit in accordance with claim 1, wherein the means for air moistening have a blow-out opening which is located in the upper region of the compartment.

14. A refrigerator unit and/or a freezer unit in accordance with claim 1, wherein the means for air moistening have a control and/or regulation unit.

15. A refrigerator unit and/or a freezer unit in accordance with claim 1, wherein the means for air moistening have at least one humidity sensor.

16. A refrigerator unit and/or a freezer unit in accordance with claim 15, wherein the at least one humidity sensor is arranged in the compartment and/or in spatial association with the compartment.

17. A refrigerator unit and/or a freezer unit in accordance with claim 1, wherein the means for air moistening are made such that a relative humidity of 85-90% is adopted in the compartment.

* * * * *